US007889218B2

(12) United States Patent
Yamamoto

(10) Patent No.: US 7,889,218 B2
(45) Date of Patent: Feb. 15, 2011

(54) HEAD MECHANISM OF THERMAL PRINTER

(75) Inventor: Toshiyuki Yamamoto, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 201 days.

(21) Appl. No.: 12/270,326

(22) Filed: Nov. 13, 2008

(65) Prior Publication Data

US 2009/0128614 A1 May 21, 2009

(30) Foreign Application Priority Data

Nov. 15, 2007 (JP) ..... 2007-296700

(51) Int. Cl.
*B41J 25/308* (2006.01)

(52) U.S. Cl. ..... 347/198; 400/120.17

(58) Field of Classification Search ..... 347/197, 347/198; 400/120.16, 120.17
See application file for complete search history.

(56) References Cited

FOREIGN PATENT DOCUMENTS

JP 2005-280017 10/2005

JP 2006-142569 6/2006

OTHER PUBLICATIONS

Machine translation of JP 2006-142569, published on Jun. 2006.*

Machine translation of JP 2005-280017, published on Oct. 2005.*

* cited by examiner

*Primary Examiner*—Huan H Tran
(74) *Attorney, Agent, or Firm*—Hunton & Williams, LLP

(57) ABSTRACT

A head mechanism of a thermal printer includes a platen roller rotatably supported by a housing, and a thermal head arranged at a front end of a head bearing member the front end of which is adapted to be rotatable about a rear end supported by the housing, and arranged to face the platen roller, and is constructed such that, during recording, a sheet provided for recording is sandwiched between the platen roller and the thermal head, and an electric current is selectively applied to heat-generating elements arranged in the thermal head, thereby obtaining desired recording. The thermal head and the platen roller are arranged to form a gap with a dimension smaller than the thickness of the sheet provided for recording during non-recording.

5 Claims, 4 Drawing Sheets

HEAD MECHANISM OF THERMAL PRINTER

CROSS REFERENCE TO RELATED APPLICATIONS

The present application contains subject matter related to and claims the benefit of Japanese Patent Application JP2007-296700 filed in the Japanese Patent Office on Nov. 15, 2007, the entire contents of which is incorporated herein by reference.

BACKGROUND OF THE DISCLOSURE

1. Technical Field

The present invention relates to a head mechanism of a thermal printer, and particularly, to a head mechanism for obtaining good recording in a thermal printer suitable for the recording that a margin is not formed at a front end in the conveying direction of a sheet.

2. Related Art

A platen roller in a head mechanism of a thermal printer can be formed from a cylindrical roller portion made of rubber, and a rotary shaft which projects from both longitudinal end surfaces of this roller portion. This rotary shaft is rotatably supported by a pair of side plates constituting a frame of the thermal printer, and is constructed so as to be rotationally driven under the transmission of the driving force of a driving motor.

A thermal head which is at a front end of a head bearing member and is always brought into pressure contact with the platen roller by the biasing force of a biasing member is arranged above the platen roller. A line-type thermal printer in which a plurality of heat-generating elements are aligned and arranged on a metallic substrate in a direction orthogonal to a conveying direction of a thermosensitive recording medium (hereinafter simply referred to as "sheet") as a sheet provided for recording is used as this thermal head.

If the tip of a sheet to be conveyed by the driving of a sheet-conveying mechanism is inserted into between the platen roller and the thermal head, the plurality of heat-generating elements of the thermal head are made to generate heat selectively with the sheet being sandwiched with pressure contact, and the platen roller is rotated, thereby performing desired recording on the sheet (for example, refer to Japanese Unexamined Patent Application Publication Nos. 2006-142569 and 2005-280017)

However, as mentioned above, the head mechanism of the conventional thermal printer is in a state where the thermal head and the platen roller are always brought into pressure contact with each other with predetermined pressure-contact pressure by the biasing force of the biasing member even after the end of recording. Therefore, in the platen roller where the roller portion is made of rubber is deformed, the portion which the thermal head is brought into pressure contact with is deformed, and pressure-contact traces are generated in the portion. Further, blurs, streaks, etc. are generated in recording results recorded on a sheet. As a result, there is a possibility that image quality may deteriorate.

For example, in a thermal printer of a type, generally called a photograph printer, which obtains desired color recording using ink ribbons, a thermal head is brought into pressure contact with a platen roller and brought into a head-down state during recording, and the thermal head is separated from the platen roller and brought into a head-up state when recording is not performed.

As such, if this up/down movement of the thermal head is performed, the problem that the image quality resulting from the aforementioned pressure-contact traces deteriorates will not occur. However, it is necessary to provide an up/down mechanism of the thermal head to that end, and it is difficult to adopt this method in a miniaturized printer. Further, the printer which performs the up/down movement of the thermal head is constructed such that the thermal head is brought into a head-down state, and then recording is started. Therefore, there is a problem that a complicated mechanism is required in order to obtain desired recording, without providing a margin at the tip of a sheet, and consequently, the cost of parts increases.

Moreover, in the related art, the thermal printer which is constructed such that the thermal head is always brought into pressure contact with the platen roller irrespective of whether or not recording is performed as mentioned above, are often utilized for recording of recording materials which do not require high printing quality, such as receipts, bar codes, and character documents.

These and other drawbacks exist. However, with the recent increase in utilization of thermal printers which are constructed such that the thermal head is always brought into pressure contact, there is a need for improved printing quality of this thermal printer.

SUMMARY OF THE DISCLOSURE

It is desirable to provide a head mechanism capable of solving the problem of pressure-contact traces of a platen roller while guaranteeing miniaturization of an apparatus, and capable of obtaining good recording results in a thermal printer suitable for the recording that a margin is not formed at a front end in the conveying direction of a sheet.

According to an aspect of the invention, there is provided a head mechanism of a thermal printer which may include a platen roller rotatably supported by a housing, and a thermal head arranged at a front end of a head bearing member, the front end of which is adapted to be rotatable about a rear end supported by the housing, and arranged to face the platen roller, and constructed such that, during recording, a sheet provided for recording is sandwiched between the platen roller and the thermal head. An electric current is selectively applied to heat-generating elements arranged in the thermal head, thereby obtaining desired recording. The thermal head and the platen roller are arranged to form a gap with a dimension smaller than the thickness of the sheet provided for recording during non-recording.

According to an exemplary head mechanism of the thermal printer, a gap may be formed between the thermal head and the platen roller during non-recording. Thus, the trouble that pressure-contact traces of the thermal head are formed on the platen roller can be prevented. Also, since the gap may be set to a dimension smaller than the thickness of a sheet provided for recording, a sheet to be conveyed to the gap can be sandwiched during recording. Further, by selectively applying an electric current to the heat-generating elements of the thermal head, and rotating the platen roller, a good recording result can be obtained.

Further, an exemplary head mechanism of a thermal printer may further include a gap adjusting means adjusting the dimension of the gap. Since such a gap adjusting means adjusting the dimension of the gap is provided, it may be possible to perform recording on sheets with various width dimensions Moreover, in an exemplary head mechanism of a thermal printer, the gap adjusting means may be adapted such that the thermal head is able to be brought close to or separated from the arrangement position of the platen roller. Specifically, the gap adjusting means may be a frame locking member adapted to be capable of adjusting the projection amount to the arrangement side of the platen roller, and adapted to be capable of abutting on the frame at its tip.

By adjusting the thermal head arranged above the platen roller in terms of the mounting structure of the head mechanism, adjustment operation becomes simple. Moreover, since the gap adjusting means in the invention may adjust the projection amount to the arrangement side of the platen roller, the thermal head can be brought close to or separated from the platen roller, and the dimension of the gap can be adjusted simply.

Further, in an exemplary head mechanism of a thermal printer, the frame locking member may be a screw member screwed into a screw hole formed in the head bearing member and adapted to be capable of adjusting the projection amount in a state where the thermal head is arranged to face the platen roller.

If a screw member is used as the frame locking member like the head mechanism of the thermal printer, the projection amount to the arrangement side of the platen roller from the head bearing member can be simply adjusted by turning the screw member in forward or reverse directions. Moreover, since the screw member may be adapted to be capable of adjusting the projection amount in a state where the thermal head is arranged to face the platen roller, the fine adjustment of the gap dimension can be performed while the gap dimension is confirmed.

As mentioned above, according to an exemplary head mechanism of the thermal printer, it may be possible to solve the problem of pressure-contact traces of the platen roller while guaranteeing miniaturization of an apparatus, and obtain good recording results in a thermal printer suitable for the recording that a margin is not formed at a front end in the conveying direction of a sheet.

DESCRIPTION OF EXEMPLARY EMBODIMENTS OF THE DISCLOSURE

The following description is intended to convey a thorough understanding of the embodiments described by providing a number of specific embodiments and details involving head mechanisms in thermal printers. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

An embodiment of the invention will be explained with reference to FIGS. 1 to 4.

Figure 1:
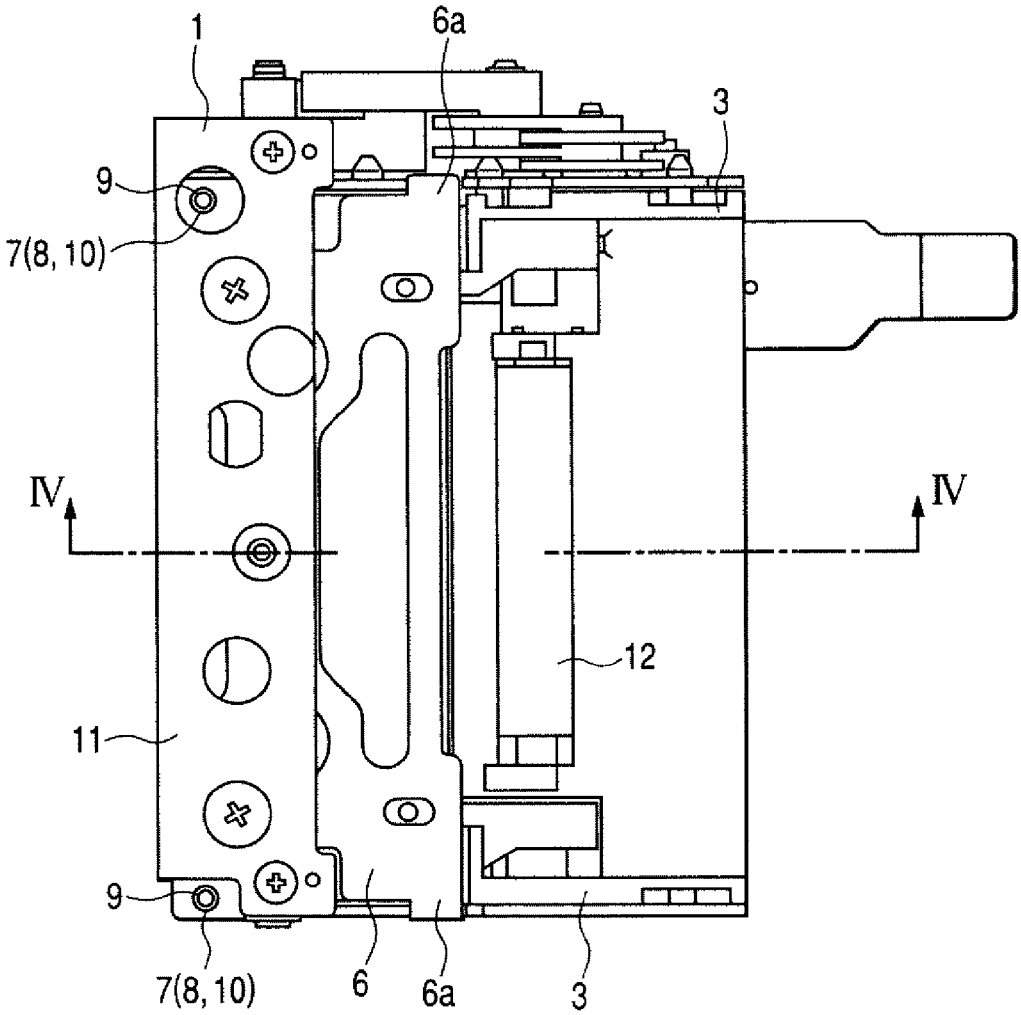
FIG. 1 is a plan view of an exemplary head mechanism of a thermal printer according to an embodiment of the invention.
Figure 2:
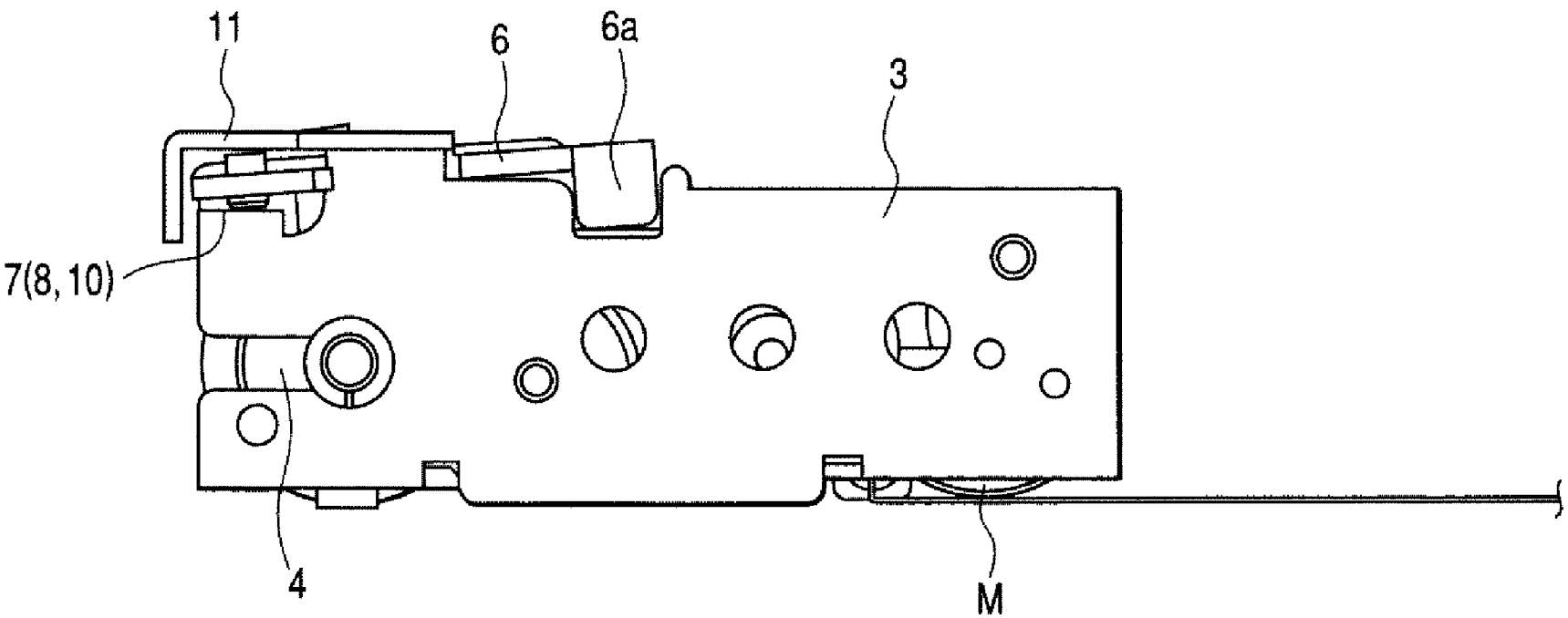
FIG. 2 is a front view of the exemplary embodiment of FIG. 1.
Figure 3:
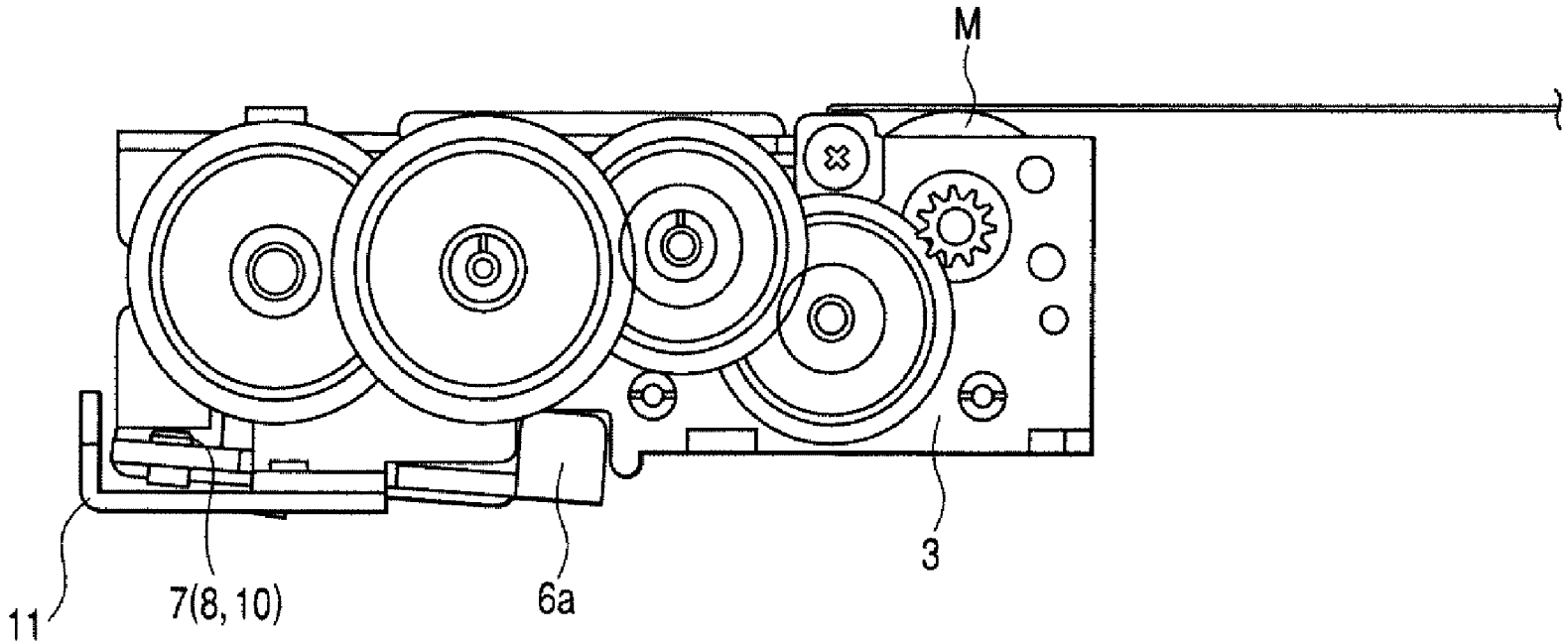
FIG. 3 is a back view of the exemplary embodiment of FIG. 1.
Figure 4:
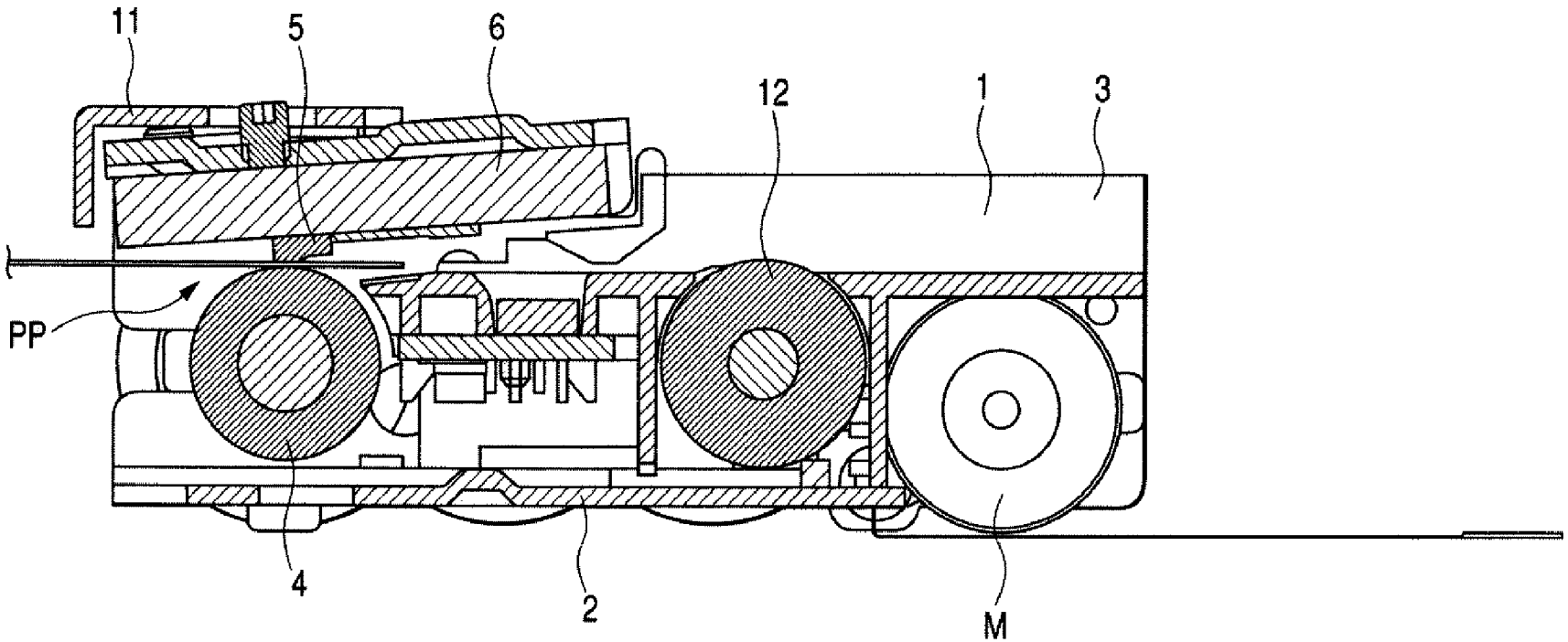
FIG. 4 is an IV-IV sectional view of the exemplary embodiment of FIG. 1.

A head mechanism of a thermal printer according to an exemplary embodiment, as shown in FIG. 1, may include a housing 1 made of a metal plate, for example, and the housing 1 may be formed substantially in a U-shape by a bottom plate 2 and frames 3 which may face each other. Also, a platen roller 4 which may be rotationally driven under the transmission of a driving force of a driving motor M may be suspended between the frames 3. A line-type thermal head 5, for example, in which a plurality of heat-generating elements may be aligned and arranged on a metallic substrate in a direction orthogonal to a conveying direction of sheets provided for recording may be arranged above the platen roller 4.

The line type thermal head 5 may be supported by a head mount (not shown), and may be attached to a front end of a substantially rectangular head bearing member 6 via the head mount.

In this embodiment, the arrangement position of the thermal head 5 may be brought close to or separated from the arrangement position of the platen roller 4 to form a gap between the platen roller 4 and the thermal head 5, and a gap adjusting means 7 for adjusting the dimension of the gap may be arranged at the front end of the head bearing member 6.

The gap adjusting means 7 in this exemplary embodiment may be a frame locking member 8 which may be adapted to be capable of adjusting the amount of projection to the arrangement side of the platen roller 4 in a state where the thermal head 5 is arranged to face the platen roller 4 and which is arranged so that its tip is able to abut on the frames 3, and specifically, is two screw members 10 whose tips may be respectively screwed into two screw holes 9 bored in the vicinity of both longitudinal ends of the thermal head 5 in the head bearing member 6, toward the platen side, and whose screw heads are made visible recognized on the upper surface of the head bearing member 6 in plan view. In this embodiment, a so-called "potato screw" may be used.

In addition, in the head mechanism of this exemplary embodiment, the projection amount of the screw member 10 to the arrangement side of the platen roller 4 may become a gap dimension between the platen roller 4 and the thermal head 5. Therefore, when the projection amount of the screw member 10 to the arrangement side of the platen roller 4 is set to 0 mm, the thermal head 5 may abut on the peripheral surface of the platen roller 4.

Also, the head bearing member 6 may be arranged such that a supporting shaft **6*a* formed at both rear ends may be supported by the frame 3, and the front end where the thermal head 5 is arranged may be supported rotatably with an abutting portion between the supporting shaft 6*a* and the frame 3** as a fulcrum.

Further, a top plate 11 which may cover an upper surface of the front end of the head bearing member 6 where the thermal head 5 is arranged and is L-shaped in section in the sheet conveying direction is fixed to the frame 3. Two coil springs (not shown) may be arranged at a distance from each other in the longitudinal direction of the thermal head 5 between the top plate 11 and the upper surface of the front end of the head bearing member 6, and may be constructed such that the thermal head 5 may be pressed toward the platen roller 4 with a proper thrust by the biasing force of each coil spring.

Therefore, the head bearing member 6 may be constructed such that the thermal head 5 is arranged to face the platen roller 4 with a desired gap therefrom by a frame locking member 8 whose tip is made to abut on the frame 3, during non-recording, and may be constructed so as to rotate with the abutting portion between the supporting shaft **6*a* and the frame 3 as a fulcrum while resisting the biasing force of the coil spring, according to the thickness of a sheet conveyed between the thermal head 5 and the platen and to make the thermal head 5** press the sheet with a proper pressure-contact pressure, during recording.

Then, in the head mechanism of the thermal printer of this exemplary embodiment, the screw member 10 serving as frame locking member 8 may be adjusted, and during non-recording, assembling adjustment may be performed such that the dimension of the gap between the thermal head 5 and the platen roller 4 may be smaller than the thickness of a sheet provided for recording.

In addition, the position where the platen roller 4 and the thermal head 5 are arranged to face each other may be a recording position PP in the thermal printer. A sheet feed roller 12 which may be rotationally driven under the transmission of the driving force of the driving motor M may be arranged on the downstream side in the conveying direction of a sheet in the recording position PP. A sheet pressure-contact member (not shown) which may be adapted to able to press a sheet along with the sheet feed roller 12 may be arranged above the sheet feed roller 12.

If a gap is formed between the thermal head 5 and the platen roller 4 during non-recording like the head mechanism of the printer of this embodiment, pressure-contact traces of the thermal head 5 will not be formed on the platen roller 4. Further, by setting the gap to a dimension smaller than the thickness of a sheet provided for recording, during recording, a sheet to be conveyed to the gap may be sandwiched. Further, by selectively applying an electric current to the heat-generating elements of the thermal head 5 and rotating the platen roller 4, a good recording result can be obtained.

A concrete method of the assembling adjustment, i.e., the formation of a gap between the platen roller 4 and the thermal head 5, and a method of the dimensional adjustment are as follows.

For example, in a case where the width dimension of a sheet provided for recording is 0.25 mm, the gap may be adjusted so as to be 0.2 mm smaller than the width dimension of the sheet.

First, the tip of a driver may be fitted into a bit groove formed in the screw head of the screw member 10 which may be the gap adjusting means 7, the frame locking member 8, and the driver may be turned such that the projection amount of the screw member 10 to the arrangement side of the platen roller 4 is set to 0 mm, and the screw member 10 may be rotated such that a formed portion of the screw hole 9 in the head bearing member 6 directly abuts on the frame 3. In this case, the thermal head 5 may be brought into a state of abutting on the peripheral surface of the platen roller 4 arranged so as to be suspended between the frames 3. From that state, the driver may be turned in the opposite direction to reversely rotate the screw member 10, and the tip of the screw member 10 may be made to project by 0.2 mm from the head bearing member 6 to the arrangement side of the platen roller 4 such that a 0.2-mm gap is formed between the platen roller 4 and the thermal head 5. The tip of the screw member 10 which has projected by 0.2 mm from the head bearing member 6 to the arrangement side of the platen roller 4 may act as the frame locking member 8, and abuts on the upper surface of the frame 3. Thereby, in this embodiment which may be constructed such that the projection amount of the screw member 10 to the arrangement side of the platen roller 4 may become the dimension of the gap between the platen roller 4 and a thermal head 5, a 0.2-mm gap can be formed between the platen roller 4 and the thermal head 5.

As such, according to the exemplary head mechanism of the thermal head 5 of this embodiment, the dimension of the gap between the platen roller 4 and the thermal head 5 can be easily adjusted by turning the screw member 10 in forward and reverse directions. Moreover, the screw member 10 may be adapted to be capable of adjusting the projection amount in a state where the thermal head 5 is arranged to face the platen roller 4. Thus, during the adjustment operation of the gap dimension, the screw member 10 can be rotated while the gap dimension is confirmed, and the fine adjustment of the projection amount becomes simple.

Also, it may be possible to perform recording on sheets with various width dimensions by adjusting the dimension of the gap between the platen roller 4 and the thermal head 5 by the gap adjusting means 7 in this way.

In addition, the invention is not limited to the aforementioned embodiment, and various changes thereof can be made if necessary.

For example, the case in which the frame locking member 8 is the screw member 10 which is screwed into the screw hole 9 formed in the head bearing member 6, and is adapted to be capable of adjusting the projection amount in a state where the thermal head 5 is arranged to face the platen roller 4 has been described in this embodiment. For example, however, the frame locking member may be a pin-like member which may be fitted into a fitting hole formed in the head bearing member 6.

Further, the gap adjusting means 7 has been described by means of the case where the arrangement position of the thermal head 5 may be brought close to or separated from the arrangement position of the platen roller 4. However, a construction in which the position where the platen roller 4 is suspended may be changed with respect to the position of the thermal head 4, and may be brought into close to or separated from the position of the thermal head 5 may be adopted.

Furthermore, although the gap adjusting means 7 is described by means of the case where the rotating head bearing member 6 is caught from below, the gap adjusting means 7 may be arranged on the side of the frame 3 of the housing, and the projection amount of the head bearing member 6 may be adjusted to perform the dimension of the gap between the platen roller 4 and the thermal head 5. Further, in this exemplary embodiment, the platen roller 4 may be constructed so as to be rotationally driven under the transmission of the driving force of the driving motor M to covey sheets. However, it also may be possible to adopt a construction in which other sheet conveying means may be provided in a printer, and the platen roller 4 may rotate to follow the conveyance of a sheet.

It should be understood by those skilled in the art that various modifications, combinations, sub-combinations and alternations may occur depending on design requirements and other factors insofar as they are within the scope of the appended claims of the equivalents thereof. Accordingly, the embodiments of the present inventions are not to be limited in scope by the specific embodiments described herein. Further, although some of the embodiments of the present invention have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A head mechanism of a thermal printer, comprising:

a platen roller rotatably supported by a housing; a thermal head arranged at a front end of a head bearing member, the front end of the head bearing member being adapted to be rotatable about a rear end supported by the housing, and is arranged to face the platen roller; and a gap adjusting means adjusting the dimension of a gap between the thermal head and the platen roller, wherein the gap adjusting means is adapted such that the thermal head is able to be brought close to or separated from an arrangement position of the platen roller, and wherein the thermal head and the platen roller are arranged to form a gap with a dimension smaller than the thickness of the sheet provided for recording during non-recording, and during recording, a sheet provided for recording is sandwiched between the platen roller and the thermal head, and an electric current is selectively applied to heat-generating elements arranged in the thermal head, thereby obtaining desired recording.

2. The head mechanism of a thermal printer according to claim 1, wherein the gap adjusting means is a frame locking member adapted to be capable of adjusting a projection amount to the arrangement position of the platen roller, and adapted to be capable of abutting on a frame at a tip of the frame.

3. The head mechanism of a thermal printer according to claim 2, wherein the frame locking member is a screw member screwed into a screw hole formed in the head bearing member and adapted to be capable of adjusting the projection amount in a state where the thermal head is arranged to face the platen roller.

4. The head mechanism of a thermal printer according to claim 1, further comprising:

a frame locking member adapted to be capable of adjusting a projection amount to an arrangement position of the platen roller, and adapted to be capable of abutting a frame at a tip of the frame.

5. The head mechanism of a thermal printer according to claim 4, wherein the frame locking member is a screw member screwed into a screw hole formed in the head bearing member and adapted to be capable of adjusting the projection amount in a state where the thermal head is arranged to face the platen roller.

* * * * *